United States Patent [19]

Takinomi et al.

[11] Patent Number: 5,003,304

[45] Date of Patent: Mar. 26, 1991

[54] PATTERN DISPLAY SIGNAL GENERATING APPARATUS AND DISPLAY APPARATUS USING THE SAME

[75] Inventors: Yutaka Takinomi; Minoru Wano, both of Kanagawa, Japan

[73] Assignees: Fujitsu Limited; Fujitsu Microcomputer Systems Limited, both of Kawasaki, Japan

[21] Appl. No.: 526,948

[22] Filed: May 23, 1990

Related U.S. Application Data

[63] Continuation of Ser. No. 169,903, Mar. 18, 1988, abandoned.

[30] Foreign Application Priority Data

Mar. 25, 1987 [JP] Japan ..... 62-70730

[51] Int. Cl.[5] ..... G09G 5/30

[52] U.S. Cl. ..... 340/801; 340/735; 340/748

[58] Field of Search ..... 340/735, 748, 790, 800, 340/801

[56] References Cited

U.S. PATENT DOCUMENTS 4,408,198 10/1983 Kudirka ..... 340/748

4,517,560 5/1985 Murayama et al. ..... 340/735

4,613,856 9/1986 Olin et al. ..... 340/735

FOREIGN PATENT DOCUMENTS 0128291 4/1984 European Pat. Off. .

*Primary Examiner*—Jeffery A. Brier

*Attorney, Agent, or Firm*—Armstrong, Nikaido, Marmelstein, Kubovcik, & Murray

[57] ABSTRACT

A pattern display signal generating apparatus comprises a memory for storing predetermined pattern data and for outputting even-numbered bits and odd-numbered bits of the pattern data in parallel when scanned, a timing generator for generating an address for scanning the memory and for generating first and second clock signal having a predetermined phase difference, a first shift register for shifting the odd-numbered bits and outputting the same in series in synchronization with the first clock signal, a second shift register for shifting the even-numbered bits and outputting the same in series in synchronization with the second clock signal, and a logical operation circuit for performing at least one predetermined logical operation between outputs of the first and second shift registers to generate a pattern display signal.

11 Claims, 4 Drawing Sheets

PATTERN DISPLAY SIGNAL GENERATING APPARATUS AND DISPLAY APPARATUS USING THE SAME

This application is a continuation of application Ser. No. 169,903, filed Mar. 18, 1988, now abandoned.

BACKGROUND OF THE INVENTION

The present invention generally relates to a pattern display signal generating apparatus, and in particular to a pattern display signal generating apparatus capable of generating a pattern display signal which enables a pattern to be displayed so that a contour of the character pattern is highlighted. The present invention further relates to a pattern display apparatus using the present pattern display signal generating apparatus.

Conventionally, various display formats are used for producing a visual image of patterns of characters figures on a picture plane, of a display unit such as television sets. A highlighting display of characters is one example of the display formats. For example, when highlighting the display of characters such as letters, numerals and symbols, the entire character is highly and uniformly intensified, or only a contour of the character is highly brightened. In the latter highlighting display, the contour of the character is visually emphasized compared to other portions thereof and is displayed.

A display apparatus comprises a pattern display signal generating apparatus for generating a pattern display signal. The pattern display signal generating apparatus includes a character generator capable of generating dot patterns of characters. One dot pattern is arranged in a dot matrix of N lines and M columns. A dot pattern signal corresponding to one character is read cut from the character generator line by line, and is supplied as a pattern display signal to a signal processing circuit. The signal processing circuit generates a video signal from the pattern display signal. The video signal is supplied to a display unit such as a cathode ray tube display unit, and the corresponding character is displayed on a display picture plane thereof.

The conventional pattern display signal generating apparatus further includes an operation circuit for generating a specific pattern display signal which enables the highlighting display of the contour of the character (hereafter referred to as a contour highlighting display signal). The operation circuit generates the contour highlighting display signal corresponding to a dot pattern of only the contour of the character by using the dot pattern signal read out from the character generator. In this case, the contour of the dot pattern has a width of one dot in a direction of lines in the pattern (raster scan direction), for example.

The contour highlighting display signal for forming the contour pattern having the width of one dot is generated by subjecting all the dots of an N x M dot matrix to the following processing. Referring to FIG. 1 which shows a portion of the N×M dot matrix, when a dot positioned at the n'th line and the m'th column (hereafter represented as (n, m)) is processed, data, of its neighboring dots, i.e., 8 dots represented by the shaded squares, are read out from the character generator in addition to the datum of the dot at the position (n, m). The operation circuit built into the pattern display signal generating apparatus performs a predetermined operation on the 9 dot data, and decides whether or not the dot at the position (n, m) is necessary to form the dot pattern of the contour. If the result of the operation is affirmative, the dot subjected to the operation is decided to be a dot forming the contour.

However, the above-mentioned process for obtaining the dot pattern of the contour is very complex. In addition, the operation circuit which is designed specifically for implementing the aforementioned process cannot generate a different contour dot pattern having a width amounting to two dots in the direction of the line for example. From this reason, a degree of flexibility in the display format of the highlighting contour is poor.

In order to eliminate the above problems, a display pattern signal generating apparatus having a configuration shown in FIG. 2 is proposed. Referring to FIG. 2, a memory 10 stores dot pattern data of various characters, and a memory 11 stores a dot pattern of a center or inner) region of each character obtained by removing a dot pattern of a contour thereof.

Data which is simultaneously read out from the memory 10 and 11 in response to the same address signal ADDS is subjected to parallel-to-serial conversion in shift registers 12 and 13, respectively. The conversion is performed in synchronization with a clock signal $\phi$ supplied to the shift registers 12 and 13. The shift registers 12 and 13 output serial signals to output terminals 14 and 15 of the pattern display signal generating apparatus, respectively. At the same time, the outputs of the shift registers 12 and 13 are supplied to an exclusive-OR circuit 16. A result of the exclusive-OR operation is a contour highlighting display signal related to the dot corresponding to the address ADDS. The contour highlighting display signal is supplied to an output terminal 17. In this manner, the contour highlighting display signal related to all the N×M dots is generated.

However, the configuration shown in FIG. 2 must store two dot patterns associated with one character, and thus a large memory capacity is necessary.

SUMMARY OF THE INVENTION

Accordingly, a general object of the present invention is to provide a novel and useful pattern display signal generating apparatus in which the disadvantages of the above conventional apparatus have been effectively eliminated.

A more specific object of the present invention is to provide a pattern display signal generating apparatus of a simple configuration.

Another object of the present invention is to provide a pattern display signal generating apparatus which can provide a higher degree of flexibility in the design of the highlighting display.

Still another object of the present invention is to provide a pattern display signal generating apparatus capable of configuring a memory of a smaller capacity than the prior art for storing dot patterns of characters.

The above objects of the present invention can be achieved by a pattern display signal generating apparatus comprising a memory for storing predetermined pattern data and separately outputting even-numbered bits and odd-numbered bits of the pattern data in parallel when scanned, a timing generator for generating an address for scanning the memory and for generating first and second clock signals having a predetermined phase difference, a first shift register for shifting the odd-numbered bits and outputting the same in series in synchronization with the first clock signal, a second shift register for shifting the even-numbered bits and outputting the same in series in synchronization with the second clock signal, and a logical operation circuit for performing at least one predetermined logical operation between outputs of the first and second shift registers to generate a pattern display signal.

A further object of the present invention is to provide a pattern display apparatus using the above pattern display signal generating apparatus.

The above object of the present invention is achieved by a pattern display apparatus comprising a control circuit (signal processing unit) for designating a character code corresponding to a character pattern to be displayed, a pattern signal generating apparatus for generating pattern display signals corresponding to a pattern to be displayed, a signal processing circuit for subjecting the pattern display signals to predetermined signal processing and for generating a corresponding video signal, and a display unit for displaying a pattern corresponding to the video signal. The pattern generating signal generating apparatus comprises a display memory for storing the character code from the control circuit, a memory (character generator) for storing predetermined pattern data and separately outputting even-numbered bits and odd-numbered bits of the pattern data in parallel when a pattern data designated by the character code from the display memory is scanned, a timing generator for generating an address for scanning the memory and for generating first and second clock signals having a predetermined phase difference, a first shift register for shifting the odd-numbered bits and outputting the same in series in synchronization with the first clock signal, a second shift register for shifting the even-numbered bits and outputting the same in series in synchronization with the second clock signal, and a logical operation circuit for performing a plurality of predetermined logical operations between outputs of the first and second shift registers to generate the pattern display signals to be supplied to the signal processing circuit.

Other objects, features and advantages of the present invention will become apparent from the following detailed description when read in conjunction with the accompanying drawings.

PREFERRED EMBODIMENT OF THE INVENTION

Figure 3:
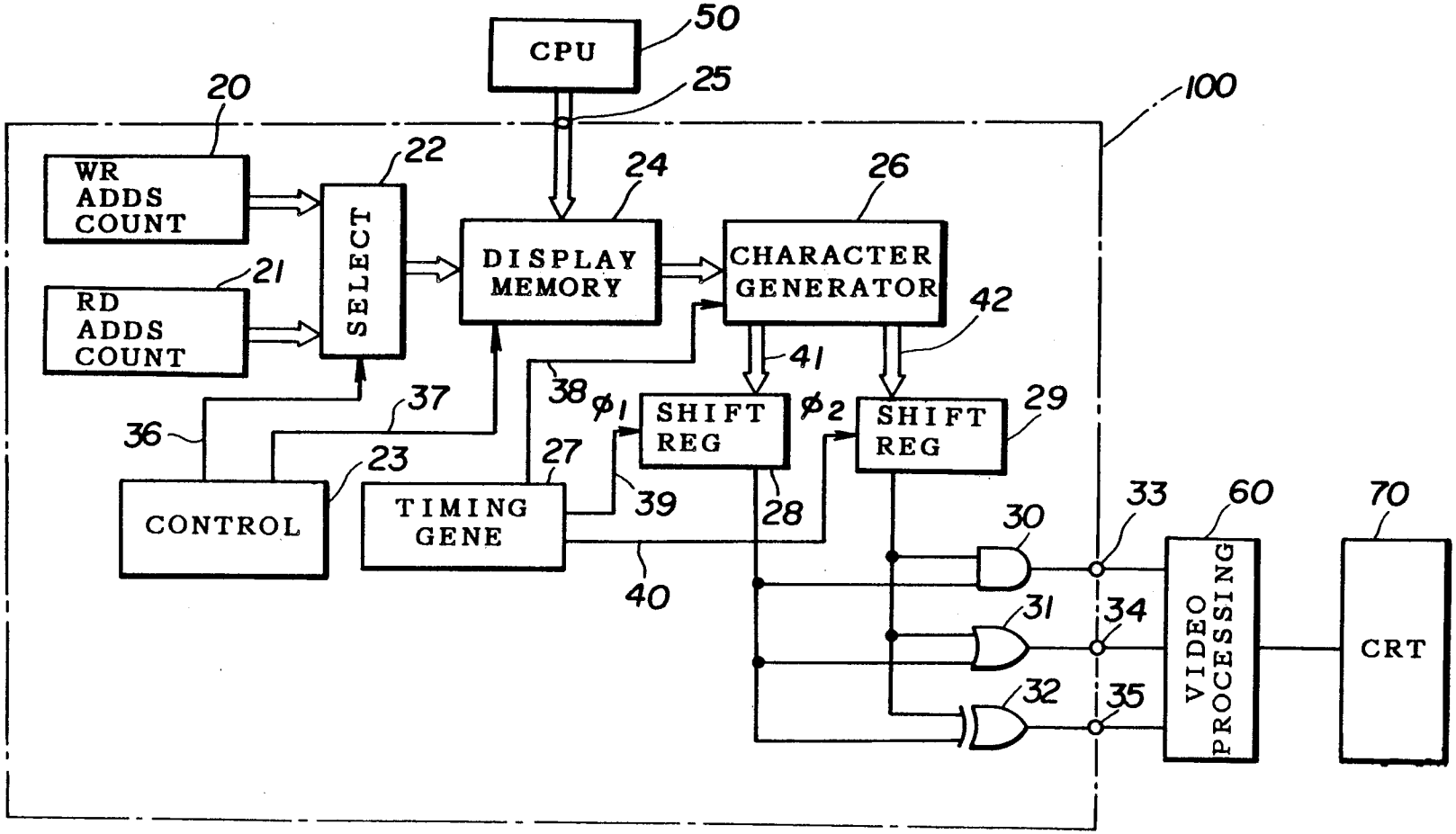
FIG. 3 is a block diagram of a preferred embodiment of the present invention which is a part constituting a visual display apparatus.

Referring to FIG. 3, a reference numeral 100 denotes a preferred embodiment of the present invention. A central processing unit (hereafter simply referred to as a CPU) 50 provides a display memory 24 with a character code corresponding to a character to be displayed through a terminal 25. A write address counter 20 generates a write address for the display memory 24, and a read address counter 21 generates a read address for the display memory 24. The write address and the read address are supplied to a selector 22. A controller 23 generates a read/write switching signal (hereafter simply referred to as R/W switching signal), and supplies the same to the selector 22 through a signal line 36. When the CPU 50 outputs the character code to the display memory 24, the controller 23 provides the selector 22 with the R/W switching signal having a signal state which designates the selection of the write address generated by the write address counter 20. At this time, the display memory 24 is maintained in a write mode which is designated by a read/write signal which is generated by the controller 23 and passes through a signal line 37.

The display memory 24 is used to temporarily store character codes, each of which indicates a corresponding character. When reading out the desired character code from the display memory 24, it is kept in a read mode designated by the read/write signal from the controller 23. The character code in the display memory 24 is read out therefrom and is supplied to a character generator 26. At this time, the controller 23 generates the R/W switching signal having a state which designates the selection of the read address generated by the read address counter 21.

Figure 4A:
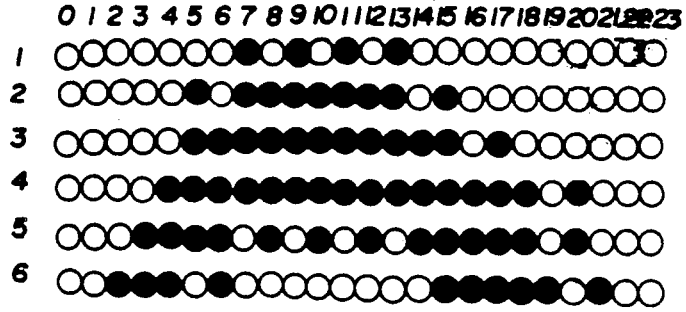
FIG. 4A is a view for showing a part of a character dot pattern stored in a character generator shown in FIG. 3.

The character generator 26 is a memory in which composite character dot patterns, each corresponding to respective character codes which are stored. Each of the composite character patterns is composed of 32 (lines) x 24 (columns) dots, for example. A composite character dot pattern is a specific dot pattern as shown in FIG. 4A. In this figure, lines following the sixth line are omitted for simplicity. A dot represented by "" denotes a binary zero, and a dot represented by " " denotes a binary one.

Figure 4B:
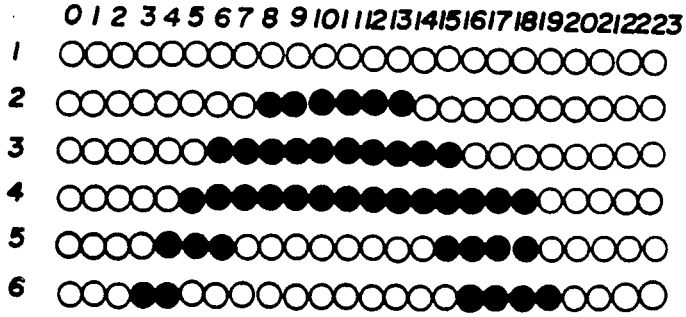
FIG. 4B through 4D are views for showing parts of character dot patterns which can be generated by the configuration shown in FIG. 3.
Figure 4C:
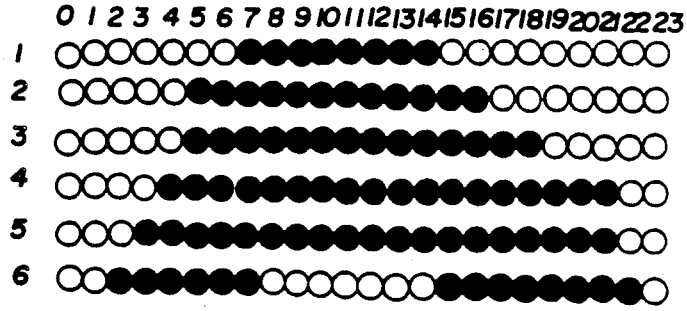
Figure 4D:
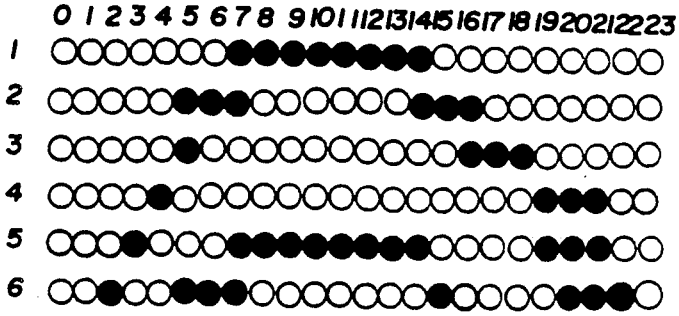

Character dot patterns stored in the character generator 26 are different from those stored in the conventional character generators. FIG. 4C shows a part of a character dot pattern which is normally stored in the conventional character generators and corresponds to the character which is the same as the character related to the specific character dot pattern shown in FIG. 4A. FIG. 4B shows a part of a dot pattern obtained by eliminating a dot pattern which forms a contour of the character dot pattern shown in FIG. 4C. That is, the dot pattern shown in FIG. 4B is the dot pattern of a center or inner portion of the character inside the contour. The dot pattern which forms the contour of the character dot pattern shown in FIG. 4B is shown in FIG. 4D. This pattern is hereafter referred to as a contour dot pattern. Various contour dot patterns can be formed without difficulties by arbitrarily extracting dots from the dot pattern shown in FIG. 4C.

A character dot pattern as shown in FIG. 4A can be obtained from its contour dot pattern, for example. By way of example, the composite character dot pattern shown in FIG. 4A can be obtained by using the contour dot pattern shown in FIG. 4D in the following manner. As will be described in detail later, the contour dot pattern shown in FIG. 4D is generated by performing the exclusive-OR operation between two adjacent dots in each line shown in FIG. 4A. For example, in the first lines shown in FIGS. 4A and 4D, the exclusive-OR operation is performed between the dots positioned at the sixth and seventh columns in the composite character dot pattern of FIG. 4A, and as a result of the operation, a value is decided for the dot at the seventh column in the contour dot pattern of FIG. 4D. Therefore, values of the dots at the seventh column in the composite character dot pattern of FIG. 4A can be obtained by use of the value of the dot at the sixth column in the dot pattern of FIG. 4A and the value of the dot at the seventh column in the dot pattern shown in FIG. 4D. Since the dot in the sixth column in FIG. 4A has a value of 0, and the dot in the seventh column in FIG. 4D has a value of 1, a value of the dot at the seventh column in FIG. 4A is decided to be 1. This step for generating the dot data of the composite character dot pattern from the contour dot pattern is carried out starting with the dot positioned at the first column for each line.

For example, when deciding values of the dots in the first line of FIG. 4A, the dot at the first column of FIG. 4D is initially processed. A value of the dot at the first column in FIG. 4D is a value of the dot at the first column in FIG. 4A as it is. Next, the dot at the second column in FIG. 4D is processed. Since the dot at the second column has a value of 0, a value of the dot at the second column is decided to be 0. In this manner, values of the dots at-up to the sixth column in FIG. 4A are decided to be 0. Thereafter, when the dot at the seventh column in FIG. 4D is processed, the value of the sixth column in FIG. 4A which has already been obtained is referred to in addition to the value of the dot at the seventh column in FIG. 4D. Since the dot at the sixth column in FIG. 4A has a value of 0. and the dot at the seventh column in FIG. 4D has a value of 1, a value of the dot at the seventh column in FIG. 4A is decided to be 1. Subsequently, the dot at the eighth column in FIG. 4D is processed. Since both the dot at the seventh column in FIG. 4A and the dot at the eighth column in FIG. 4D have a value of 1 , a value of the dot the eighth column in FIG. 4A is decided to be 0. In the above manner, the composite character dot pattern of FIG. 4A can be obtained by using the contour dot pattern of FIG. 4D.

The above process may be summarized as follows. Firstly, consecutive black dot data in each line of the contour dot pattern shown in FIG. 4D are represented by an arrangment of consecutive dot data in the corresponding line of the composite character dot pattern shown in FIG. 4A, in which black dot data are arranged for every other dot. Secondly, consecutive white dot data inside the contour dot pattern are represented by an arrangment of consecutive black dot data in the corresponding line of the composite character dot pattern shown in FIG. 4A. Thirdly, a change from a white dot datum to a black dot datum in each line is represented as it is in the corresponding line of the composite character dot pattern shown in FIG. 4A. White dot data outside the contour dot pattern are represented as they are.

Returning to FIG. 3, a timing generator 27 supplies the character generator 26 with a raster address signal for designating the 32 lines in sequence through an address line 38. Thereby, data of the dots in the designated line of the composite character dot pattern corresponding to the character code are successively read out from the character generator 26 in a parallel form line by line. At this time, even-numbered bits are read out in parallel on a bus line 41, and odd-numbered bits are read out in parallel on a bus line 42.

Figure 5:
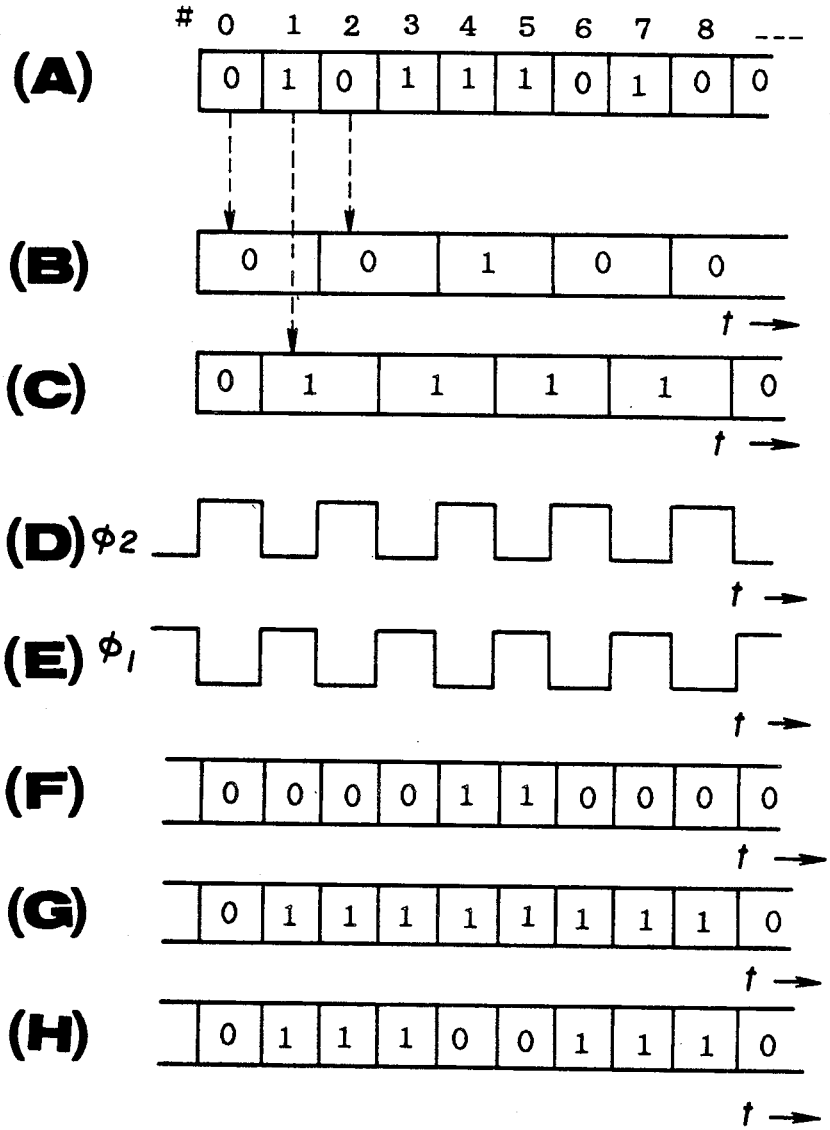
FIGS. 5(A) through 5(H) are views for explaining digital signals at different parts in the configuration shown in FIG. 3.

FIG. 5A shows a part of data which is simultaneously read out from the character generator 26 in which the even-numbered bits and the odd-numbered bits are arranged on the same axis in sequence for simplicity of the figure. The even-numbered bits and the odd-numbered bits are supplied to shift registers 29 and 28 through the bus lines 42 and 41, respectively. As shown in FIGS. 5(D) and 5(E), the shift registers 28 and 29 are provided with clock signals $\phi_1$ and $\phi_2$ having a phase difference of, 180° which are generated by the timing generator 27 and pass through signal lines 39 and 40 respectively. The shift register 28 shifts each of the odd-numbered bits in parallel by respective predetermined times in synchronization with the clock signal $\phi_1$, as shown in FIG. 5(C). In FIG. 5(C), a horizontal direction represents time. Then, the odd-numbered bits are output per one bit in series starting with the smallest odd-numbered, bit (#1, in the illustrated example). Each of the output bits has a pulse width twice that of the original pulse width. Likewise, the shift register 29 shifts each of the even-numbered bits in parallel by respective predetermined times in synchronization with the clock signal $\phi_2$, as shown in FIG. 5(B). Then, the even-numbered bits are output per one bit in series starting with the smallest even-numbered bit (#0, in the illustrated example). Each of output bits has a pulse width twice that of the original pulse width.

Figure 1:
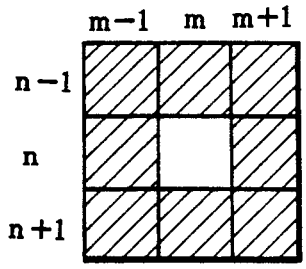
FIG. 1 (PRIOR ART)
FIG. 1 is a view for explaining an example of the conventional apparatus for generating a display signal for displaying a highlighted contour of a character.
Figure 2:
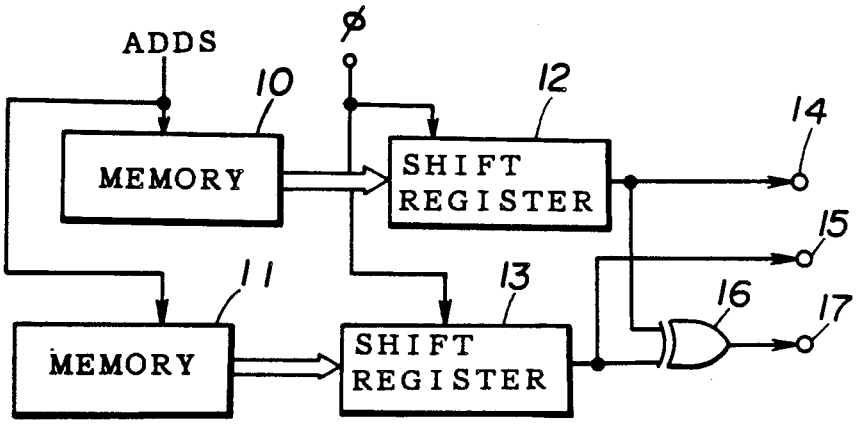
FIG. 2 (PRIOR ART)
FIG. 2 is a block diagram of an another example of the conventional apparatus for generating a display signal for displaying highlighting contour of a character.

As shown in FIGS. 5(B) and 5(C), adjacent even-numbered and odd-numbered bits shown in FIG. 5(A) overlaps with each other on a time axis. The serial data from the shift registers 28 and 29 are supplied to an AND circuit 30, an OR circuit 31 and an exclusive OR circuit 32. Output signals of the AND circuit 30, OR circuit 31 and exclusive-OR circuit 32 shown in FIGS. 5(F) through 5(H) are supplied to output terminals 33, 34 and 35, respectively. The output signal of the AND circuit 30 is a pattern display signal for displaying the pattern shown in FIG. 4B, which is the same as the pattern stored in the memory 11 shown in FIG. 2. The output signal of the OR circuit 31 is a pattern display signal for displaying the pattern shown in FIG. 4C, which is the same as the pattern stored in the memory 10 shown in FIG. 2. The output signal of the exclusive-OR circuit 32 is a contour highlighting display signal for displaying the pattern shown in FIG. 4D, which is the same as the signal at the terminal 17 shown in FIG. 2. It will be appreciated that the three different pattern display signals obtained by the present embodiment are generated from one pattern stored in the character generator 26. On the other hand, the conventional apparatus utilizes the two character generators each having the same memory capacity as that for the present embodiment. As a result, according to the embodiment, the memory capacity is half that for the conventional apparatus. In addition to the above advantage, different contour highlighting display signals can be easily obtained by varying the composite character dot patterns stored in the character generator 26. These results in an improved degree in the flexibility of the design of the display patterns.

The output signals from the AND circuit 30, OR circuit 31 and exclusive-OR circuit 32 are supplied to a conventional signal processing circuit 60, respectively. The signal processing circuit 60 generates a video signal from the above-mentioned output signals. At this time, the luminance of the video signal may be controlled by the above-mentioned output signals. For example, the luminance of the video signal corresponding to the contour of the character is emphasized, compared to that for the inner portion thereof. The video signal is supplied to a cathode ray tube 70, so that the character is displayed on its picture plane in a state where the brightness of the contour is highlighted.

The present invention is not limited to the above embodiment, but various variations and modifications may he made without departing from the scope of the present invention.

What is claimed is:

1. A pattern display signal generating apparatus comprising:

a first bus line for odd-numbered bits;

a second bus line for even-numbered bits;

memory means for storing predetermined pattern data and for separately outputting even-numbered bits, to said second bus line, and odd-numbered bits, to said first bus line, of the pattern data in parallel when scanned;

timing generating means for generating an address for scanning the memory means and for generating first and second clock signals having a predetermined phase difference;

first shift register means for shifting the odd-numbered bits on said first bus line for outputting the same in series in synchronization with the first clock signal;

second shift register means for shifting the even-numbered bits on said second bus line and for outputting the same in series in synchronization with the second clock signal wherein a timing with which the first shift register outputs the odd-numbered bits overlaps a timing at which the second shift register outputs the even-numbered bits; and logical operation means for performing at least one predetermined logical operation between outputs of the first and second shift register means to generate a pattern display signal.

2. A pattern display signal generating apparatus as claimed in claim 1, wherein the first and second clock signals have a phase difference of 180°, and therein the logical operation means performs the predetermined logical operation between adjacent even-numbered and odd-numbered bits which overlaps with each other on a time axis.

3. A pattern display signal generating apparatus as claimed in claim 1, wherein the predetermined pattern data is data generated from data related to a contour portion of a corresponding pattern, and the predetermined pattern data has (a) a first bit arrangement in which consecutive black dot data, of binary ones in each line of the contour pattern data, are represented in said predetermined pattern data by consecutive dot data having black dot data for every other dot, and (b) a second bit arrangement in which an area inside the contour portion is represented in said predetermined pattern data by consecutive black dot data, and (c) a third bit arrangement in which a change from a white dot datum to a block dot datum in said contour portion is represented as it is in said predetermined pattern data.

4. A pattern display signal generating apparatus as claimed in claim 1, wherein the logical operation means is an exclusive-OR circuit, and an output of the exclusive-OR circuit forms a contour pattern display signal which is used for highlighting a display of a contour of a pattern.

5. A pattern display signal generating apparatus as claimed in claim 1, wherein the logical operation means is an AND circuit, and an output signal of the AND circuit forms a display signal for displaying an inner portion of a pattern excluding a contour portion thereof.

6. A pattern display signal generating apparatus as claimed in claim 1, wherein the logical operation means is an OR circuit, and an output signal of the OR circuit forms a display signal for displaying the whole pattern.

7. A pattern display signal generating apparatus as claimed in claim 1, wherein the pattern display signal generating apparatus further comprises display memory means for supplying a character code to the memory means as an address signal, a read/write address supply means for supplying read and write addresses for the display memory means, and an address selecting means for selecting one of the read and write addresses from the read/write address supply means.

8. A pattern display apparatus comprising:

control means for designating a character code corresponding to a character pattern to be displayed;

pattern signal generating means for generating pattern display signals corresponding to a pattern to be displayed;

signal processing means for subjecting the pattern display signals to predetermined signal processing and for generating a corresponding video signal; and display means for displaying a pattern corresponding to the video signal, the pattern generating signal generating means comprising:

a first bus line for odd-numbered bits, a second bus line for even-numbered bits, a display memory means for storing the character code from the control means, memory means for storing predetermined pattern data and for separately outputting even-numbered bits, to said second bus line, and odd-numbered bits, to said first bus line, of the pattern data in parallel when a pattern data designated by the character code form the display memory means is scanned, timing generating means for generating an address for scanning the memory means and for generating first and second clock signals having a predetermined phase difference, first shift register means for shifting the odd-numbered bits on said first bus line and for outputting the same in series in synchronization with the first clock signal, second shift register means for shifting the even-numbered bits on said second bus line and for outputting the same in series in synchronization with the second clock signal wherein a timing with which the first shift register outputs the odd-numbered bits overlaps a timing at which the second shift register outputs the even-numbered bits, and logical operation means for performing a plurality of predetermined logical operations between outputs of the first and second shift register means to generate the pattern display signals to be supplied to the signal processing means.

9. A pattern display apparatus as claimed in claim 8, wherein the logical operation means is composed of an AND circuit, an OR circuit, and an exclusive-OR circuit.

10. A pattern display apparatus as claimed in claim 9, wherein the first and second clock signals have a phase difference of 180°, and therein the logical operation means performs the predetermined logical operations between adjacent even-numbered and odd-numbered bits which overlaps with each other on a time axis.

11. A pattern display apparatus as claimed in claim 10, wherein the predetermined pattern data is data generated from data related to a contour portion of a corresponding pattern and wherein the predetermined pattern data has (a) a first bit arrangement in which consecutive black dot data, of binary ones in each line of the contour pattern data, are represented in said predetermined pattern data by consecutive dot data having black dot data for every other dot, and (b) a second bit arrangement in which an area inside the contour portion is represented in said predetermined pattern data by consecutive black dot data, and (c) a third bit arrangement in which a change from a white dot datum to a black dot datum in said contour portion is represented as it is in said predetermined pattern data, and wherein an output signal of the exclusive-OR circuit forms a display signal of a contour portion of the character pattern, and wherein the signal processing means processes the video signal so that by use of the pattern display signal of the contour portion, the contour portion is highlighted on a picture plane of the display means.

* * * * *